US011279548B1

(12) United States Patent
Hugo

(10) Patent No.: US 11,279,548 B1
(45) Date of Patent: Mar. 22, 2022

(54) DISPENSER TUBE

(71) Applicant: Edgar Hugo, Miami, FL (US)

(72) Inventor: Edgar Hugo, Miami, FL (US)

( * ) Notice: Subject to any disclaimer, the term of this patent is extended or adjusted under 35 U.S.C. 154(b) by 0 days.

(21) Appl. No.: 17/028,213

(22) Filed: Sep. 22, 2020

(51) Int. Cl.
*B65D 83/00* (2006.01)

(52) U.S. Cl.
CPC ..... *B65D 83/0005* (2013.01)

(58) Field of Classification Search
CPC .. B65D 83/00; B65D 83/0005; B65D 81/325; B05B 11/02
USPC ..... 222/386.5, 106, 107, 108, 92, 109–113, 222/386, 207, 213, 387–389, 380, 494; 401/256, 55
See application file for complete search history.

(56) References Cited

U.S. PATENT DOCUMENTS 2,085,446 A * 6/1937 Philippe ..... A45D 40/0075 222/386
2,763,405 A * 9/1956 Shvetz ..... A45D 40/0075 222/320
3,249,265 A * 5/1966 Wershaw ..... B65D 83/0044 222/320
4,380,951 A * 4/1983 Bottoms ..... F16J 9/00 92/244
4,781,483 A * 11/1988 Lorscheidt ..... B65D 41/0435 215/341
5,052,592 A * 10/1991 Wilken ..... B65D 83/0033 222/212
5,125,539 A * 6/1992 Schneider ..... B05B 11/0027 222/144.5
5,513,778 A * 5/1996 Cardia ..... A45D 40/0075 222/327
5,833,382 A * 11/1998 Jenks ..... A45D 40/02 401/82
6,309,124 B1 * 10/2001 Gueret ..... A45D 34/045 401/123
2008/0169312 A1 * 7/2008 Kee ..... B65D 83/0033 222/205
2012/0085788 A1 * 4/2012 Lu ..... A45D 34/04 222/390
2016/0088921 A1 * 3/2016 Jo ..... B05B 11/3052 222/173
2019/0358099 A1 * 11/2019 Langer-Anderson ..... A61F 13/00072
2019/0388920 A1 * 12/2019 Kim ..... B05B 11/02

* cited by examiner

*Primary Examiner* — Lien M Ngo
(74) *Attorney, Agent, or Firm* — Christopher J. Vandam, PA; Chris Van Dam

(57) ABSTRACT

A container for dispensing personal hygiene products comprising a tube with a piston section fit into one and a head assembly and closing the opposite end. The head assembly has a concave top with an aperture through which the contents of the tube are dispensed when the piston is pressed by the user. A Is provided with an opposing convex surface to create a volume between the head assembly and the cap assembly wherein a small amount of dispensed material may be stored.

5 Claims, 3 Drawing Sheets

DISPENSER TUBE

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to personal hygiene products, and more particularly, to an improved device for dispensing gels, creams and similar soft consumable products.

2. Description of Related Art Including Information Disclosed Under 37 CFR 1.97 and 37 CFR 1.98

Several designs for dispensing personal products have been designed in the past. None of them, however, includes an environmentally friendly dispenser with simplified mechanics to dispense soft gels and creams with a single finger operated piston delivering the product dispensed to a concave dish that holds and aids in dispensation of those products.

Applicant believes that the closest prior art references include commonly available roll-on and twist up deodorant dispensers. The roll-on dispensers must be made of precision manufactured polymers to ensure that the devices do not leak yet allow the ball to roll and apply the liquid contained within the bottle. These roll-on type containers are only suited to lower viscosity liquids. They are not suitable to be used with gels and creams.

Similarly, twist up dispensers are also commonly used for personal hygiene products such as deodorant. However, these will work only with solids that are able to maintain their shape as they are pushed out of the container by twisting a dial on the tube. These are also precision tubes that must generally be made of polymers that are not always Earth-friendly and require complex mechanisms to function.

Other common personal product dispensers include designs such as a toothpaste tube, jars, bottles, aerosols, sprayers and other similar designs. Each of these fails to provide a device that can be made of biodegradable materials and that could be made without the use of precision manufactured plastics. The present design has only one moving part: the piston. Unlike all other prior art designs, the present device is suitable for dispensing a wide range of viscosities, from a very low viscosity to semisolid gels and pastes.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide an ecologically friendly dispenser for personal hygiene products.

It is another object of this invention to provide an easy to manufacture device with a single moving part.

Another object of the present invention is to provide a device that is suitable for dispensing a variety of products with a wide range of viscosities.

It is yet another object of the present invention to provide a device capable of dispensing a little or a lot of product simply by pressing one's finger against the piston.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
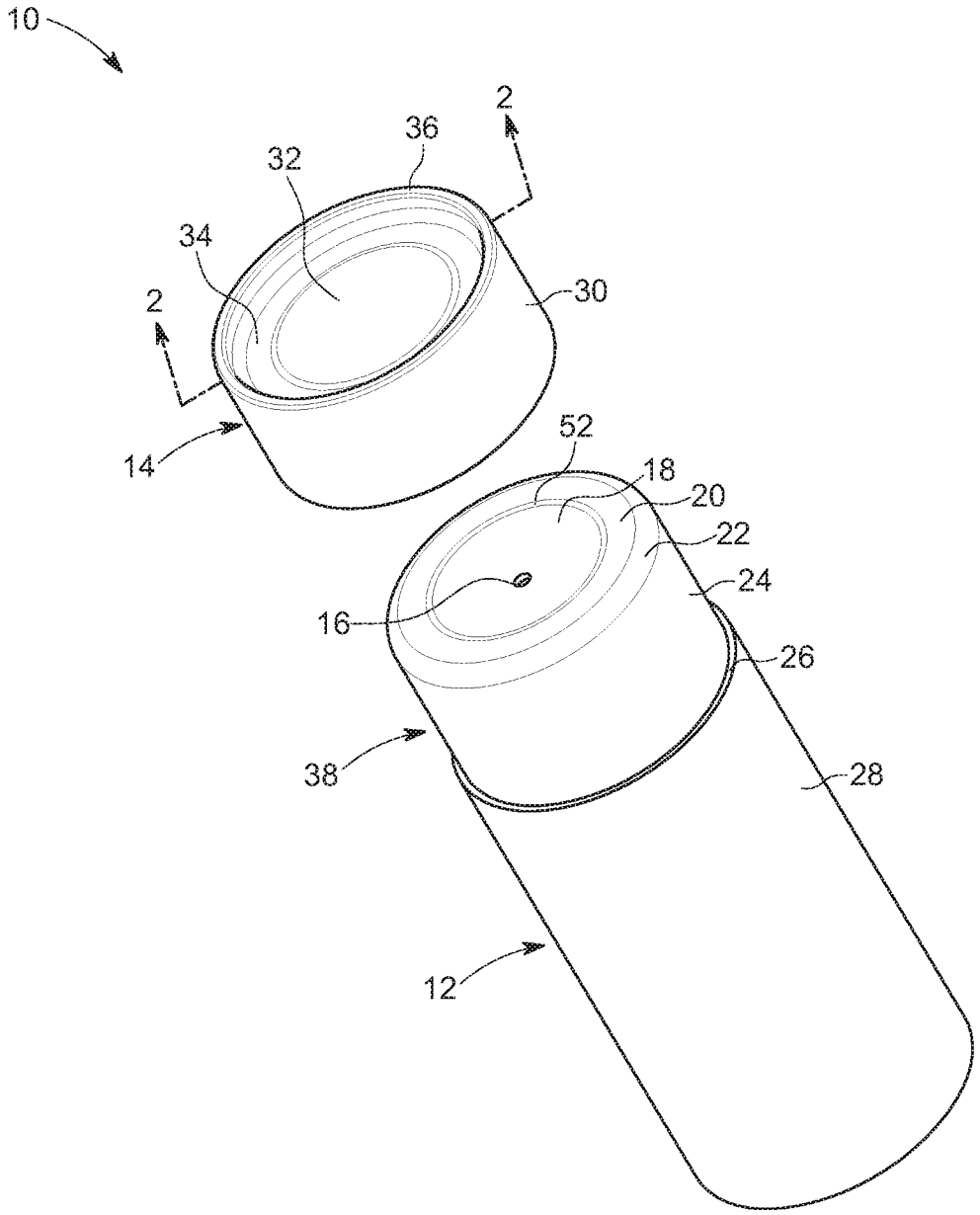
FIG. 1 shows a perspective view of a dispensing tube with the cap assembly removed.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the dispenser tube, the tube, the dispenser, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes, among other features, a body assembly 12, a cap assembly 14, an aperture 16, a dish 18, a rim 20, a bevel 22, a surface 24, a flange 26, a body 28, a side wall 38, a dome 32, a rim 34, an edge 36, a head assembly 38, a piston 40, a volume 42, an interior 44, a surface 46, a face 48, an inner wall 50 and a bevel 52.

Generally, the dispenser tube is comprised of a body assembly 12, a head assembly 38 and a cap assembly 14. The body assembly 12 is formed of a tubular structure with a hollow interior 44 that contains the product to be dispensed. A bottom end of the tube is sealed with a movable piston 40. An upper end of the body 28 is enclosed by the head assembly 38.

During manufacturing the piston 40 is inserted into the lower portion of the body 28. The interior 44 is then filled with the dispensed product. The head assembly 38 is then adhered to the exterior periphery of the inner wall 50. A removable, friction fit cap assembly 14 is then slid over the edge surface 24 of the head assembly 38 to close the package.

To dispense of the product a user presses against the surface 46 of the piston 40 to apply pressure on the face 48 of the piston against the dispensed material contained in the interior 44 and forces it through the aperture 16 where the amount of material immediately to be dispensed rests in the dish 18. This may be done with the cap assembly 14 in place on the head assembly 38 or removed.

Continuing in this example, the user then grasps the body assembly 12 and removes the cap assembly 14, if not already removed. The material in the dish 18 may then be directly wiped onto the user's skin. As more material is dispensed, the user may apply more pressure to the surface 46 of the piston 42 dispense more fluid through the aperture 16 and into the dish 18 to continue dispensing.

It should be appreciated that the interior 44 may contain a wide range of fluid viscosities. On one end of the spectrum, a low viscosity fluid, such as a tincture may be suitable for the dispenser tube because the fluid can rest in the dish 18 and be held in place when the cap assembly 14 is in place. The fluid would then be held in the volume 42 until dispensation is wanted and the cap assembly 14 is removed. Higher viscosity gels and creams may function equally well. The pressure applied by the wide face 48 of the piston 40 may generate substantial pressure in the interior 44 to dispense much thicker fluids.

Any version of the device may be suitable for any of the wide range of products to be dispensed disclosed herein. The list examples are not intended to be limiting. A highly viscous or even somewhat solid gel or colloid may readily be dispensed by the tube. In some instances the diameter of the aperture 16 may be adjusted to control the volume that is dispensed through the aperture 16 under normal finger pressure on the surface 46 of the piston 40 or to compensate for the viscosity of the product being dispensed.

Essentially, if the dispensed product can be compressed and forced out through the aperture 16 then it may be a suitable product for the dispenser tube. The terms fluid, gel, paste, colloid, solid, product, tincture and other similar terms are used interchangeably and are intended to be illustrative and not limiting to a particular dispensed product.

As pressure is applied to the surface 46 of the piston 40 the user can dispense the contents through the aperture 16 where they rest in the dish 18 waiting application onto the user. The dish 18 is dimensioned both in depth and width to hold a predetermined volume of fluid needed in a typical dispensing stroke or session. The user grasps the body 28 and gently rubs the rim 20 flush on their skin to transfer the fluid from the device to the intended surface.

The rim 20 is bounded on an exterior perimeter by bevel 22 and on an interior perimeter by bevel 52. These bevels 22 and 52 provide a gentle surface that contacts the user skin. This is an advantage over a hard corner on the upper side of the head assembly 38 that may tend to dig into the skin upon application causing an uneven spread of the dispensed fluid or minor injury or scratch to the user.

At any time, if there is fluid in the dish 18 the cap assembly 14 may be replaced onto the head assembly 38 to form the protective volume 42 to store the fluid for a later application. The volume 42 is preferably leak-proof when the cap assembly 14 is fully slid onto the head assembly 38. In this configuration the rim 34 of the cap assembly 14 on a bottom side seals around its entire periphery against the upper side of the rim 20 on the head assembly 38.

The seal between the rim 20 and rim 34 also keeps the contents of the volume 42 and interior 44 free from contamination. By having the dome 32 raised up away from the bottom of the dish 18 the fluid in the dish 18 might not contact and contaminate the interior of the dome 32.

In typical use, a user would first remove the cap assembly 14 from the head assembly 38. The cap assembly 14 may be friction fit onto the head assembly 38 so that the user merely has to pull the cap assembly 14 away from the head assembly 38 to expose the dish 18 and aperture 16. Alternatively, the cap assembly 14 may be threaded onto the head assembly 38 or connected to the head assembly 38 through other commonly available means.

The user would then apply pressure to the surface 46 of the piston 42 forcing the face 48 of the piston further into the interior 44, pressurizing the material to be dispensed therein and forcing at out of the aperture 16 and into the dish 18. The user would then grasp the exterior of the body 28 and put the rim 20 of the head assembly 38 against the skin or other surface to which the material is being applied and move the body 28 to smear or spread the material in the dish 18 onto the skin.

The user may then elect to press further on the surface 46 the piston 42 dispense more material and continue to spread the material pumped onto the dish 18 onto the desired surface. When the user has completed applying the material they may replace the cap assembly 14 onto the head assembly 38 effectively re-closing the dispenser tube. The contents of the interior 44 may then be dispensed at a later time convenient to the user and is preserved from contamination.

To achieve the ecological and economically friendly characteristics of the dispensing two, the body 28 and head assembly 38 may be made of materials such as cardboard, card stock, plastic, metal, glass or other similar material that may be able to effectively contain the contents of the interior 44. For some of these materials a coating may be required to ensure that the material to be dispensed from the interior 44 does not negatively interact with the interior wall of the body 28.

For example, in a preferred embodiment the interior of the body 28 may be coated with a wax, foil or polymer thin film to prevent the moisture or other attributes of the material to be dispensed from degrading either the body 28 or the purity and nature of the products being dispensed with the dispenser tube. The material of the body 28 should not affect the material being dispensed and the material being dispensed should not affect the body 28.

In the example of the dispenser tube where the body 28 is constructed of cardboard, the head assembly 38 may be made of a rigid materials such as aluminum or other metal. During manufacture, after the piston 40 is inserted into the lower portion of the body 28 effectively sealing off the bottom of the body 28, the interior 44 is filled with the fluid to be dispensed. The head assembly 38 at the surface 24 is then permanently adhered to the inner wall 50 of the body assembly 12. The side wall 30 of the cap assembly 14 is then slid over the surface 24 of the head assembly 38 and is frictionally held into place.

In other embodiments the entirety of the head assembly 38 and body assembly 38 may be made of recyclable cardboard materials. In yet other embodiments any material able to sufficiently hold the fluid to be dispensed in the interior 44 may be equally effective.

In one of the preferred embodiments, the piston is made of felt or wool, alone or in combination. These materials add to the environmentally friendly nature of the dispenser. However, it should be appreciated that any material that allows the piston to slide against the interior of the body and tightly fit into the interior of the body 28 to dispense the fluid contained therein would be suitable. For example, plastics, polymers, metals or other solid materials may be used alone or in combination when constructing the piston 40.

As noted above, a wide variety of products may be dispensed with the present dispenser tube. The dispenser tube is particularly adapted to use with personal products such as shampoo, hand sanitizer, deodorant, cosmetics, toothpaste, sunscreen, moisturizer or a wide variety of other similar personal hygiene products.

In at least one embodiment of the invention the major diameter of the cap assembly 14 is the same diameter as the major diameter of the body assembly 12. When the cap assembly 14 is completely engaged over the head assembly 38 only a barely visible seem between the cap assembly 14 and body assembly 12 is visible. In this sense the completed device appears nearly perfectly cylindrical, with the exception of the visible dome on the top side of the cap assembly 14. In other words, the sides of the dispenser tube may be completely flush in this embodiment.

Figure 2:
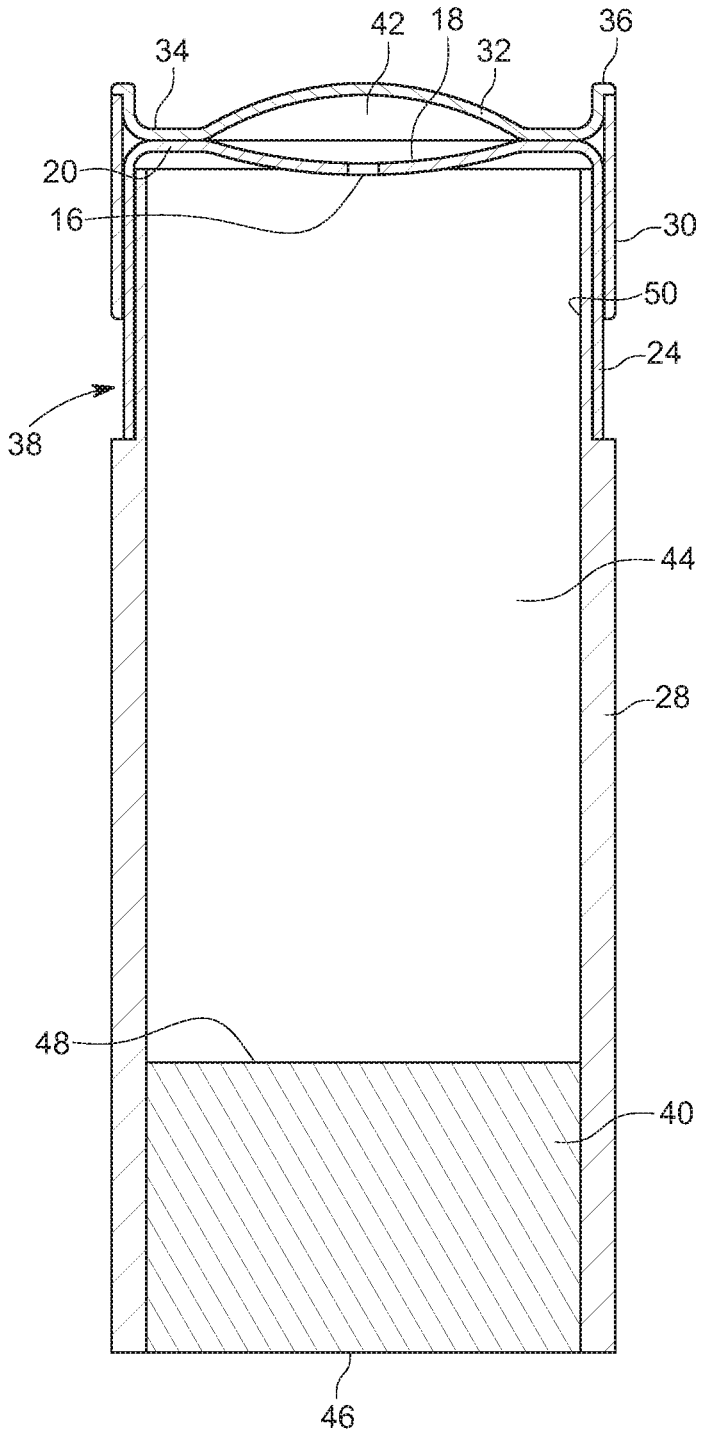
FIG. 2 shows a cross-section elevation view of an example of a dispensing tube.
Figure 3:
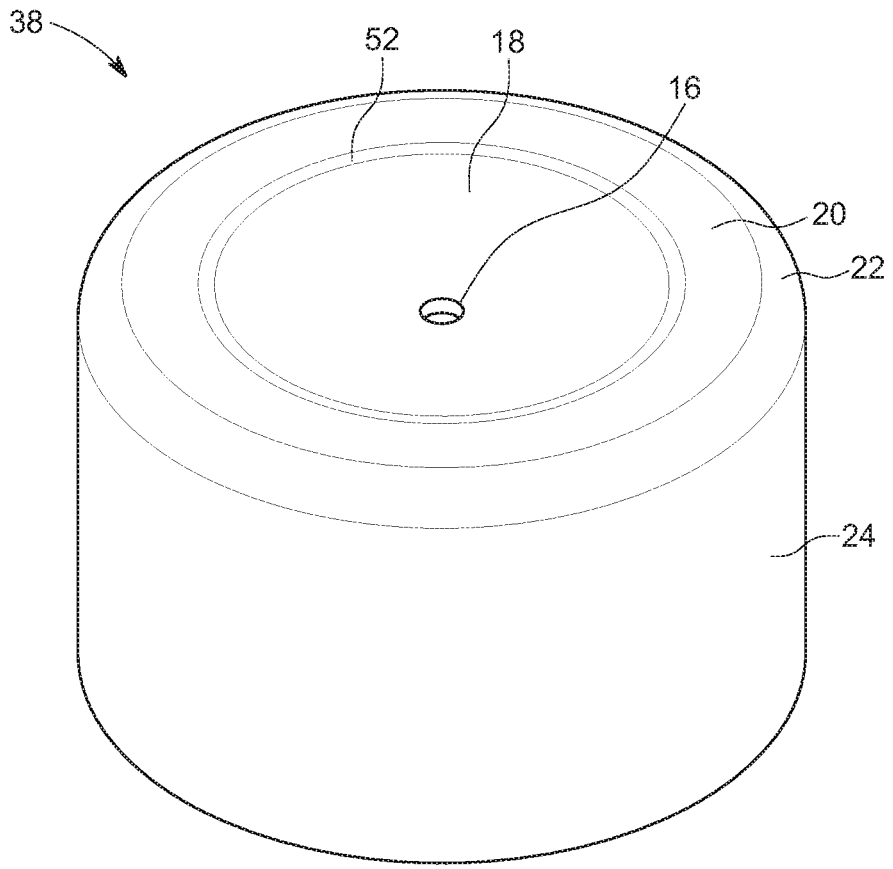
FIG. 3 shows a perspective view of a version of a head assembly.

An important version of the inventive concept can be fairly described as dispenser tube comprised of a body assembly, a head assembly and a cap assembly. The body assembly is comprised of a tubular shaped body with an open interior. The body is enclosed on a first end with a movable piston. The body is enclosed on a second end with the head assembly. The head assembly on an upper surface comprises a concave dish. The dish has an aperture in communication with (providing access to) the interior. A product is enclosed in the interior. The product is for example a cream, paste, lotion, gel or other product being dispensed by the device. When a bottom surface of the piston is pressed the piston compresses the product contained in the interior thereby increasing pressure in the interior and expelling a portion of the product through the aperture and into the dish. The cap assembly is comprised of a sidewall and a dome. When the cap assembly is engaged over the head assembly (as shown in FIG. 2) the sidewall is frictionally held onto an exterior surface of the head assembly and the dome is centered over the dish creating a sealed volume between the cap assembly and the head assembly where a small portion of the product is protected and stored. Optionally, the piston is comprised of felt or wool. Optionally, the body is comprised of cardboard. Optionally, the head assembly is comprised of metal.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A dispenser tube comprised of a body assembly (12), a head assembly (38) and a cap assembly (14);

the body assembly (12) is comprised of a tubular body (28) with an open interior (44);

the body (28) is enclosed on a first end with a piston (40);

the body (28) is enclosed on a second end with the head assembly (38); the head assembly (38) on an upper surface comprises a concave dish (18); the dish (18) is fixed in position relative to the head assembly (38);

the dish (18) has a single aperture (16) in communication with the interior (44); a product is enclosed in the interior (44);

when a bottom surface (46) of the piston (40) is pressed directly by a finger of a user the piston (40) compresses the product contained in the interior (44) thereby increasing pressure in the interior (44) and expelling a portion of the product through the single aperture (16) and into the concave dish (18);

at the top of the concave dish on the head assembly is a circular bevel;

at an outer edge of the circular bevel is a circular rim;

at an outer edge of the circular rim is a second circular bevel;

wherein each of the first and second bevels are configured to provide a gentle surface that contacts the user's skin;

the cap assembly (14) is comprised of a sidewall (30) and a dome (32) within which a portion of undispensed product is retained;

when the cap assembly (14) is engaged over the head assembly (38) the sidewall (30) is frictionally held onto an exterior surface (24) of the head assembly (38) and the dome (32) is centered over the concave dish (18) creating a sealed volume (42) between the cap assembly (14) and the head assembly (38).

2. The dispenser tube of claim 1 further characterized in that the piston (40) is comprised of felt or wool.

3. The dispenser tube of claim 1 further characterized in that the body (28) is comprised of cardboard.

4. The dispenser tube of claim 1 further characterized in that the head assembly (38) is comprised of metal.

5. The dispenser tube of claim 1 further characterized in that the piston (40) is comprised of felt or wool and the body (28) is comprised of cardboard and the head assembly (38) is comprised of metal.

* * * * *